United States Patent [19]

Orr

[11] 3,936,084

[45] Feb. 3, 1976

[54] PRIVACY LOCK

[75] Inventor: John L. Orr, Rockford, Ill.

[73] Assignee: Keystone Consolidated Industries, Inc., Peoria, Ill.

[22] Filed: July 5, 1974

[21] Appl. No.: 485,992

[52] U.S. Cl. ..... 292/169.15; 292/175; 292/DIG. 30

[51] Int. Cl.[2] ..... E05C 1/10; E05C 1/16

[58] Field of Search ..... 292/138, 145, 164, 169.15, 292/169.16, 169.21, 169.22, 169.23, 336.3, DIG.30

[56] References Cited

UNITED STATES PATENTS

| | | | |
|---|---|---|---|
| 2,087,829 | 7/1937 | Wraae | 292/164 |
| 2,263,477 | 11/1941 | Voight | 292/169.16 |

*Primary Examiner*—Albert G. Craig, Jr.
*Attorney, Agent, or Firm*—Molinare, Allegretti, Newitt & Witcoff

[57] ABSTRACT

A plastic privacy lock for recreation vehicles and the like includes an outside handle portion for the outside of a door and an inside portion for the inside of a door. The outside portion includes an outside handle having a rotatable outside latch lever to operate a bolt on the inside portion. The inside portion includes a handle and a housing with the bolt in the housing. The bolt and an inside bolt actuator are formed as a single integral molded plastic part positioned within the housing. To move the bolt out of engagement with a strike from the inside, manual operation of the molded plastic bolt against the force of a biasing spring is required. A locking bar or dog having a locked and unlocked detent position is also provided in the housing. The locking bar is accessible from the inside portion of the lock. In locked position, the locking bar holds a bolt shifter connected to the outside latch lever to prevent rotation and operation of the lock. When the locking bar is disengaged from the shifter, the latch may be opened from either side. Manual movement of the bolt will automatically transfer the locking bar from the locked to the unlocked position. An access opening to the locking bar is provided in order to unlock the latching bar from the outside of the lock.

8 Claims, 13 Drawing Figures

FIG.1
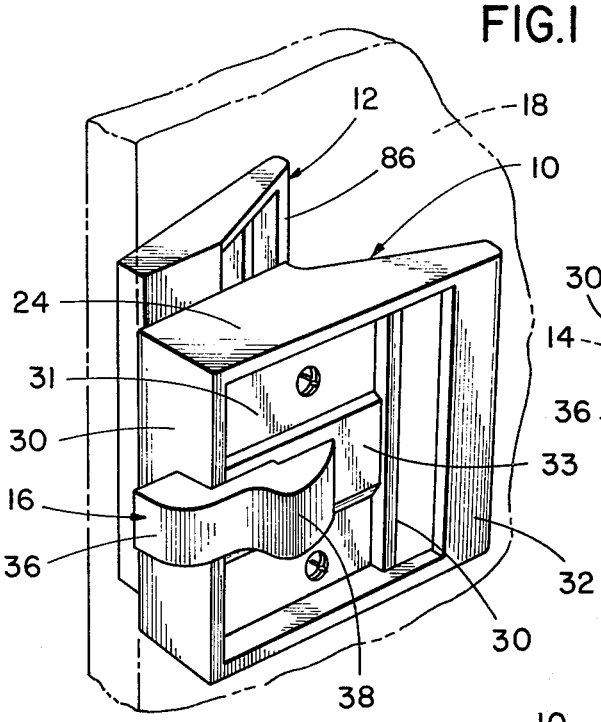
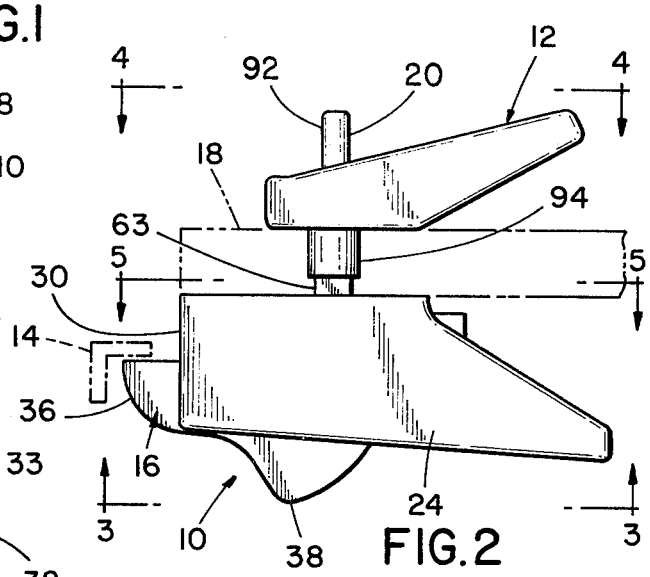
FIG.2
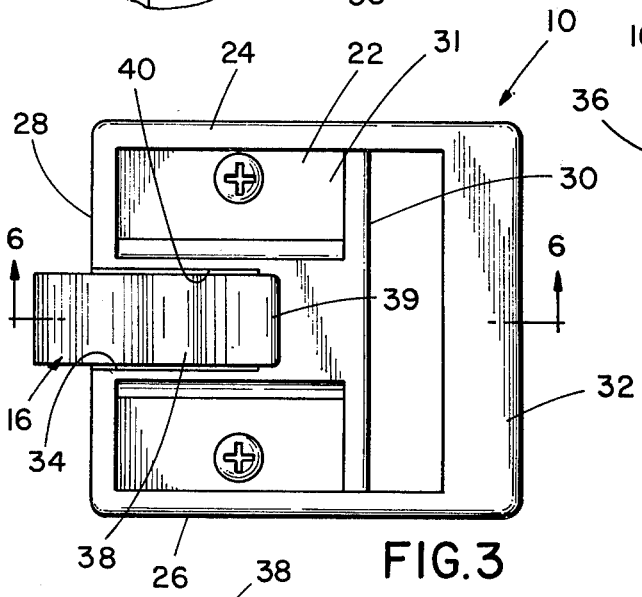
FIG.3
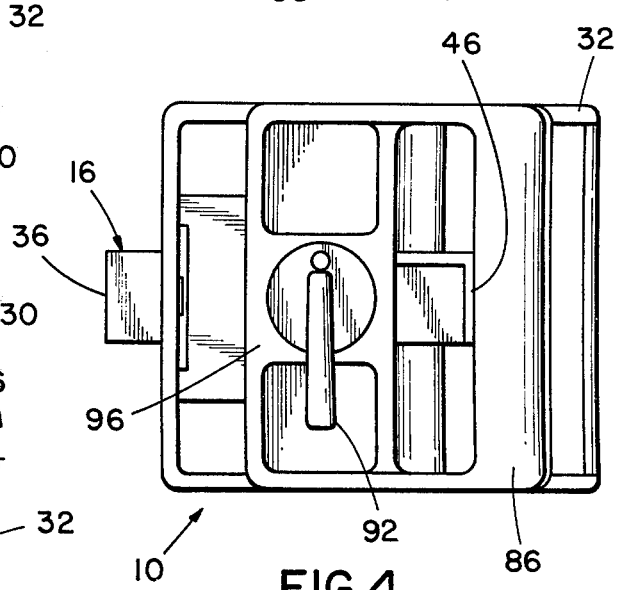
FIG.4
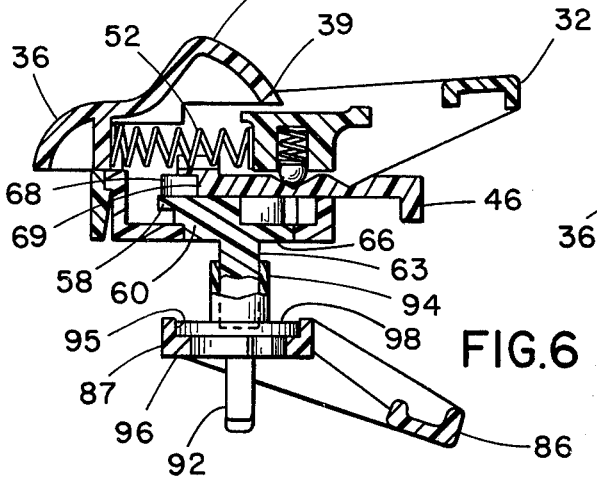
FIG.6
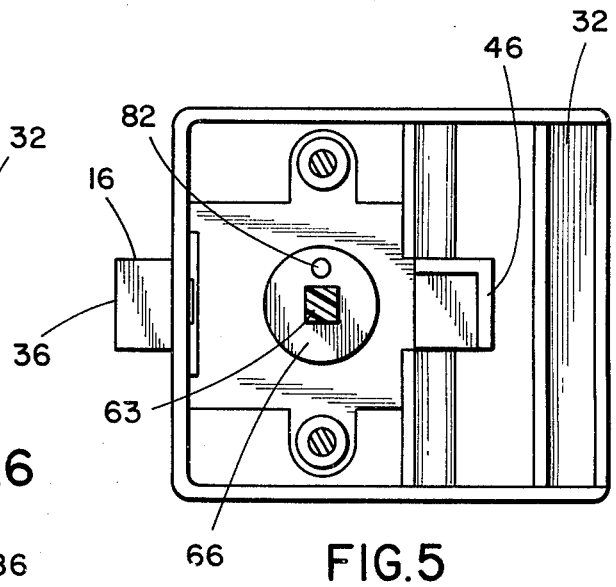
FIG.5

PRIVACY LOCK

BACKGROUND OF THE INVENTION

In a principle aspect, the present invention relates to an improved privacy lock especially useful for recreational vehicles and the like. The lock is preferably fabricated from molded plastic material.

A privacy door lock of low cost, lightweight construction and simple design in a desirable item, particularly for use with recreational vehicles. Such a privacy lock can, for example, be utilized on the bathroom door of a house trailer. As such, the lock will provide a normal spring biased bolt action. Additionally, such a lock includes a locking feature whereby the door may be locked from the inside to prevent unwanted access. It is also desirable that such a lock will automatically unlock upon movement of the bolt out of engagement with the strike by operation of a bolt actuator from the inside. Finally, such a lock will incorporate a safety feature whereby access to a locked room may be obtained from the outside by means of an instrument such as a rod or a wire to disengage the locking mechanism.

In the past, the concept of a privacy lock having the above features has been provided by many alternative designs. A typical design incorporates knobs which are rotatable by manual operation. A button in the center of one knob may be depressed to lock the knob and its attached bolt from the inside. Rotation of the knob from the inside will release the locking button. U.S. Pat. No. 2,644,704 shows such a design.

Such constructions, though quite satisfactory in their function and operation, are generally fabricated from metal. Additionally, such structures usually require a multiplicity of part. Consequently manufacturing costs for labor and materials may be relatively high. Nonetheless, recreational vehicles and the like require such locks. Compactness, low cost and simplicity of design are therefore essential features for an improved privacy lock construction for recreational vehicles. The structure of the present invention provides such features.

SUMMARY OF THE INVENTION

The privacy lock of the present invention is comprised generally of a housing for attachment to the inside of a door or panel. Positioned within the housing is a spring biased bolt adapted to project into engagement with a strike on a door frame. The bolt includes a portion which extends outwardly from the housing transverse to the direction of bolt movement. The projecting portion is provided for manual operation of the bolt.

A handle and drive knob are positioned on the opposite side of the door panel. The drive knob engages a shifter within the housing that in turn moves the bolt to a retracted position upon rotation of the shifter.

A locking bar or catch is also provided in the housing on the inside of the lock. The catch includes first and second detent positions corresponding respectively to the locked and unlocked position of the privacy lock. When in the locked detent position, the locking catch engages the shifter preventing rotation thereof. The bolt can be moved to engage the locking catch and drive the catch transversely out of engagement with the shifter in order to shift the locking catch from the locked to the unlocked position. Access to a cam surface on the locking lever is provided through an opening in the shifter drive knob. The locking catch may be moved to the unlocked position by engaging the cam surface with a rod or probe.

It is thus an object of the present invention to provide an improved compact privacy lock construction.

It is a further object of the present invention to provide a privacy locking construction which may be fabricated from molded plastic materials.

One further object of the present invention is to provide a privacy lock construction wherein the bolt mechanism includes a bolt actuator operable to disengage the bolt from the strike as well as deactivate the locking mechanism.

Another object of the present invention is to provide a privacy lock construction comprised of a unique combination of elements and parts cooperative to provide various functions hereinafter described in greater detail. These and other objects, advantages, and features of the invention will be set forth in greater detail in the description which follows.

BRIEF DESCRIPTION OF THE DRAWING

In the detailed description which follows, reference will be made to the drawing comprised of the following figures:

FIG. 1 is a perspective view of the improved lock of the present invention as it would be incorporated on a door or panel;

FIG. 2 is a side view of the improved lock of the present invention;

FIG. 3 is a plan view of the inside or bolt side of the lock of the present invention taken along the line 3—3 in FIG. 2;

FIG. 4 is a plan view of the outside of the lock of the present invention taken along the line 4—4 in FIG. 2;

FIG. 5 is a cross-sectional view taken substantially along the line 5—5 in FIG. 2;

FIG. 6 is a cross-sectional view of the lock mechanism of the present invention taken substantially along the line 6—6 in FIG. 3;

DESCRIPTION OF THE PREFERRED EMBODIMENT

Figure 7:
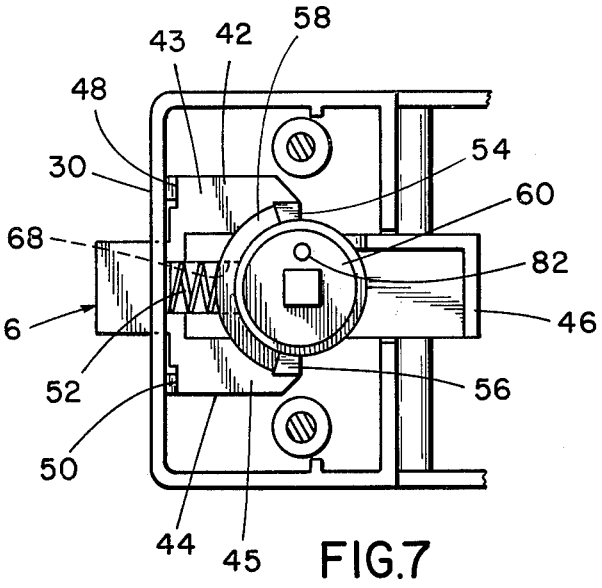
FIG. 7 is a plan view of the internal mechanism of the lock of the present invention with the housing removed.

In the following description, like numbers are used on like parts in all of the figures. Referring therefore to the figures, the privacy lock of the present invention is comprised of an inside assembly 10, an outside assembly 12 and a strike 14. As shown in FIGS. 1 and 2, the inside assembly 10 is attached, for example, to the inside of a bathroom door or panel. A bolt 16 projecting from the inside assembly 10 is normally biased to engage the strike 14 thereby holding the panel 18 in a closed position. To open the panel 18 from the inside, the bolt 16 is manually displaced out of engagement with the strike 14. To open the panel 18 from the outside, a rotatable drive knob 20 is operated to disengage the bolt 16 from the strike 14.

THE INSIDE ASSEMBLY

The inside assembly 10 includes a housing 22 to retain the mechanism for locking and operating the bolt 16. The particular shape of the housing is not of critical significance, although the preferable shape is substantially rectangular. The housing 22 and a bottom retainer 62 cooperate to form an enclosure for the operating mechanism of the assembly. The housing 22 thus includes a pair of opposed side walls 24 and 26 and spaced interconnecting walls 28 and 30. A top wall 31 connects all the other walls 24, 26, 28 and 30 to complete the housing enclosure. A handle 32 is integrally molded with the housing 22. The housing 22 and, in fact, all of the major parts of the lock of the present invention are preferably manufactured from a molded plastic material.

A slot 40 is formed in the mid-part of the top wall 31 and connects with a bolt opening 34 in wall 30, Slot 40 and opening 34 are formed to receive and cooperate with bolt 16. Slot 40 thus extends about half the distance between walls 28 and 30. Opening 34 extends about half the distance through wall 30. Thus an outside surface land 33 of wall 31 and the bottom surface 35 of opening 34 cooperate with bolt 16 to position and guide the bolt 16.

The bolt 16 thus includes a forwardly extending strike engaging portion 36 and an upwardly extending thumb engagement portion 38. The thumb portion 38 projects above the top wall 31 of the housing 22 in a direction perpendicular to the normal direction of travel of the bolt 16. Movement of the thumb portion 38 by manual operation of the bolt 16 thus causes relocation of the entire bolt 16.

The portion 38 extends through the slot 40 defined in top wall 31. A flange portion 39 of the bolt 16 extends from the thumb portion 38 to maintain the bolt 16 in housing 22 even when bolt 16 is extended as in FIG. 3. Flange portion 39 thus cooperates with surface land 33.

Figure 8:
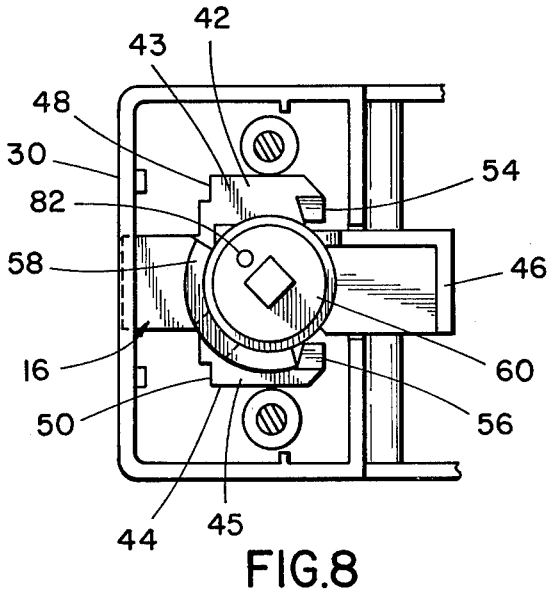
FIG. 8 is a view similar to FIG. 7 wherein the shifter has been manually rotated to disengage the bolt from a strike.
Figure 9:
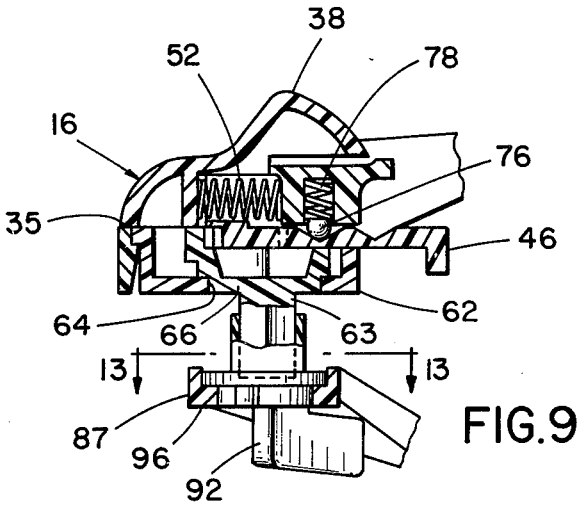
FIG. 9 is a cross-sectional view similar to FIG. 6 wherein the lock in the position illustrated in FIG. 8.

The remaining portion of the bolt 16 is defined by a pair of bifurcated arms 42 and 44 in the enclosure of housing 22. The structure of these arms 42 and 44 is illustrated in greater detail in FIGS. 7, 8 and 11. The arms 42 and 44 are separated so that a locking catch or bar 46 may slide freely therebetween. The arms 42 and 44 each include leading shoulder surfaces 48 and 50, respectively, which are adapted to cooperate with wall 30 and limit the travel of the bolt 16 in response to biasing force of a spring 52. Spring 52 is positioned intermediate bolt 16 and the middle of wall 30 in a pocket defined by the thumb portion 38 and arms 42, 44.

At the end of each bifurcated arm 42 and 44 opposite the shoulders 48 and 50, respectively, the arms 42 and 44 terminate with upwardly extending projections 54 and 56. The projections 54 and 56 cooperate with a radial flange 58 on a shifter 60. Shifter 60 is mounted within the housing 22 for rotation about an axis perpendicular to the direction of bolt travel. The travel of the bolt 16 in response to rotation of the shifter 60 is thus dependent upon the radial distance between the point flange 53 of shifter 60 engages projections 54 and/or 56 of bolt 16 and the axis of rotation of shifter 60. By adjusting the particular radial distance, it is possible to adjust the amount of travel imparted by shifter 60 to the bolt 16.

The shifter 60 is retained within the housing 22 by means of the bottom retainer 62 as shown in FIGS. 6, 9, 10 and 12. That is, the bottom retainer 62 includes an opening 64 therethrough. The opening 64 defines a flange cooperative with an annular ridge 66 adjacent flange 58 to thereby maintain the shifter 60 in rigid communication with shifter sliding or bearing surfaces 43 and 45 defined on the arms 42 and 44, respectively, of the bolt 16. A four-sided port 63 projects from the shifter 60 outwardly from the plane defined by ridge 66 and retainer 62.

Figure 10:
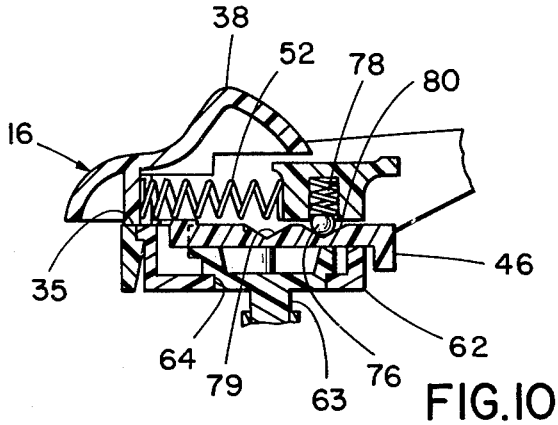
FIG. 10 is a cross-sectional view similar to FIG. 6 wherein the locking lever has been moved to the locked position.

The shifter 60 includes a radial slot 68 in its bottom surface through flange 58. When shifter 60 is in position for free movement by rotation thereof, the slot 68 does not receive any member or other projection. However, when the locking catch 46, positioned intermediate the shifter 60 and the bolt 16, is transported to its locking position as illustrated in FIG. 10, a locking projection 69 is likewise transported into the slot 68. This prevents rotation of the shifter 60 and operation of the bolt 16 by shifter 60.

Simultaneous with transfer of the locking catch 46 to the locking position illustrated by FIG. 10, the locking catch 46 which also includes a forward end projection 70, is positioned intermediate the bifurcated arms 42 and 44. The end projection 70 engages inner shoulders 72 and 74 defined on arms 42 and 44 respectively. Thus, though the locking catch 46 is shifted to the locked position as illustrated for example in FIG. 11, the bolt 16 may be manually displaced toward the unlocked or strike non-engagment position. Simultaneously, the locking catch 46 is transported toward the unlocked position by cooperation of shoulders 72, 74 and projection 70 thereby disengaging the sliding member 69 from the slot 68.

A spring biased detent ball 76 biased by spring 78 is retained in the thick mid-part of wall 30. Ball 76 cooperates with detent openings 79 or 80 of catch 46 to retain the locking catch 46 in the unlocked or locked positions respectively. The unlocked position is thus illustrated in FIG. 9. The locked position is illustrated in FIG. 10.

Figure 11:
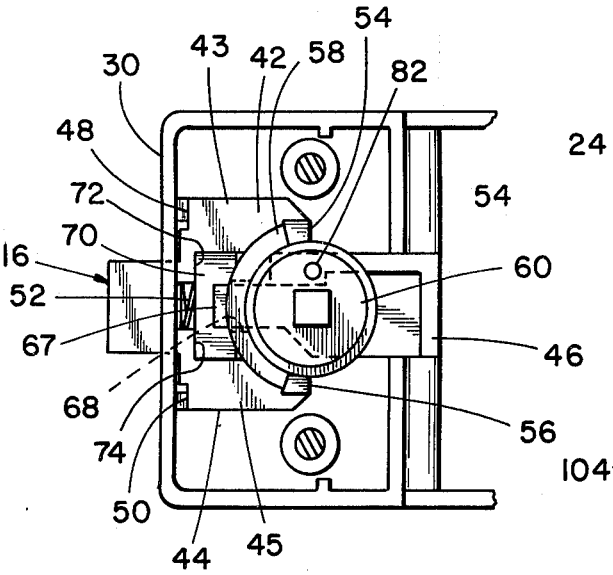
FIG. 11 is a plan view similar to FIG. 7 showing the lock in the position illustrated by FIG. 10.
Figure 12:
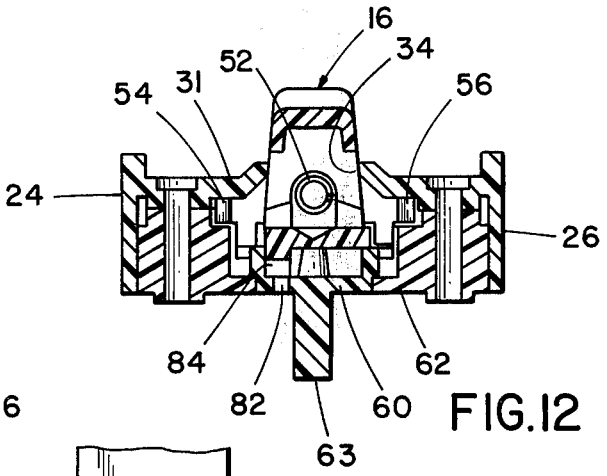
FIG. 12 is a cross-sectional view of the lock mechanism of the present invention transverse to FIGS. 9 and 10.

An alternative method for release of the locking catch 46 is illustrated in FIGS. 5, 11 and 12. There an access opening 82 is provided through the shifter 60. When the locking catch 46 is in the locked position as shown in FIG. 12, a rod or probe (not shown) may be directed through the access opening 82 to engage a cam surface 84 on catch 46 and drive the locking catch 46 to the right as illustrated in FIG. 11. The catch 46 thus releases the shifter 60 for rotation.

THE OUTSIDE ASSEMBLY

The outside assembly 12 includes a handle 86 which extends from a panel attachment section 86. Screw fasteners 88 and 89 extending through openings in housing 22 and the bottom retainer 62 of the inside assembly 10 are threadably received by the section 87. In this manner, both the inside assembly 10 and outside assembly 12 are retained together in fixed position on the panel 18.

The outside assembly 12 includes a shifter drive knob 92 mounted in an opening 95 in panel section 87. The drive knob 92 includes an extension 94 keyed to the port 63 extending from the shifter 62. In this manner, rotation of the drive knob 92 effects a like rotation of the shifter 62. The panel section 87 thus includes a flange 96 about opening 95 which cooperates with a circular complementary flange 98 of the shifter drive knob 92. In this manner, the shifter drive knob 92 is retained in position against panel 18.

Figure 13:
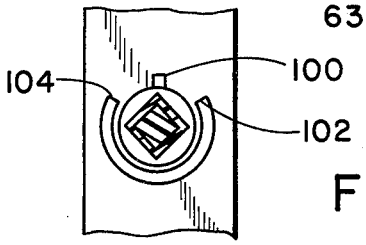
FIG. 13 is a cross-sectional view taken along the line 12—12 in FIG. 9.

The recess in panel section 87 defined by the flange 96 is not precisely circular as illustrated in FIG. 13. Stops 102 and 104 are included. Also, the flange 98 includes a projection 100. Projection 100 cooperates with stops 102 and 104, thereby limiting the travel of the shifter drive knob 92 and the consequent amount of rotation which may be imparted to the shifter 60 by the knob 92. Finally, knob 92 includes an access opening 85 normally aligned with opening 82 for access by a probe to cam surface 84 as previously described. The locking lever 46 may thus be unlocked from the outside of the door or panel 18.

OPERATION

Thus, it can be seen that the structure of the present invention provides for a bolt 16 normally biased outwardly for engagement with a strike 14. Locking the door or panel 18 from the inside is effected by movement of the locking bar or catch 46 to prevent rotation of shifter 60. Unlocking of the locking catch 46 may be effected manually by moving the bolt 16, i.e., thumb projection 38, or by driving the cam surface 84 through access opening 82 and corresponding access opening 85 in the knob 92.

The amount of rotation of the shifter 60 is limited by cooperation of the knob projection 100 and stops 102, 104. The bolt 16 cooperates with the housing 22 to insure retention thereby. The locking catch 46 cooperates with the bifurcated arms 42, 44 of the bolt 16 to maintain proper alignment of the bolt 16 and the locking catch 46. Additionally, the locking catch 46, when in the locked position, includes projection 69 that engages the shifter slot 68 and prevents rotation of shifter 60, consequently preventing operation of the bolt 16 by rotation of the knob 92.

The particular structure of the invention is especially compact and may be easily fabricated from plastic material thereby making it a desirable product for use in recreational vehicles and the like. However, the invention is not limited to a plastic component structure. Other materials may be used in the fabrication of the device. The invention is therefore to be limited only by the following claims and their equivalents.

What is claimed is:

1. An improved privacy lock construction comprising, in combination;

a housing for attachment to a panel, said housing including a bolt opening at one side;

a bolt projecting from said housing through said opening for cooperation with a strike, said bolt including a manual engagement portion external the housing on another side of said housing, said bolt also including bifurcated, separated arms extending within the housing opposite the direction of projected bolt travel, toward the strike, each of said arms including engagement means;

biasing means in said housing engaging said bolt and biasing said bolt toward the projected position;

rotatable shifter means rotatable substantially about an axis normal to the direction of bolt travel, said shifter means extending from within said housing intermediate said bolt arms, said shifter means including a post extending along the axis of rotation for connection with shifter drive means on the opposite side of said panel from said housing, said shifter means including radial projecting means for engaging said engagement means of said bolt and for driving said bolt against the biasing means upon rotation of said shifter means in either direction; and a fixed, outside handle for attachment to the panel on the opposite side from said housing, said handle including an opening therethrough including an overlying flange for retaining shifter drive means against the panel.

2. The improved lock of claim 1 wherein said outside handle includes a recess and wherein said shifter drive means includes a cooperating tab within said recess, said tab engageable with the edges of said recess to limit the rotation of said shifter drive means and the attached shifter means.

3. The lock of claim 1 including a locking catch projecting into said housing and manually engageable to be positioned in a bolt lock and unlocked position, said catch including a projection member slidably receivable by said shifter whenever said locking catch is moved to the locked position.

4. The improved privacy lock of claim 3 wherein said locking catch includes a leading edge section slidably received between the bifurcated arms of said bolt, said bolt and said locking catch being directly engaged along the line of bolt travel whenever said catch is in the locked position and separated whenever said catch is in the unlocked position, said bolt being manually transportable against said locking catch to disengage said locking catch from the locked position.

5. The improved privacy lock of claim 3 including detent means for maintaining said locking catch in the locked or unlocked position.

6. The improved privacy lock of claim 3 including an access opening defined in said lock from the side of the panel opposite the housing, said access opening positioned over a cam surface defined on said locking catch whenever said locking catch is in the locked position whereby a probe may be inserted through said opening to engage the cam surface and move said locking catch from the locked position.

7. The improved privacy lock of claim 1 wherein said bolt includes a projection extending transverse to the direction of normal bolt travel from said housing, said projection being manually responsive, said projection also cooperative with said housing to engage and be stopped against said housing whenever said bolt is moved to the bolt unlocked position.

8. An improved privacy lock comprising, in combination: a housing having a biased bolt projecting therefrom for engagement with a strike, a shifter mounted in said housing for rotation about an axis substantially normal to the direction of bolt movement, said shifter cooperatively engaging said bolt upon rotation of said shifter to cause movement of said bolt against the biasing force thereon, said shifter cooperable with manually operated drive means, and a locking catch having a locked and an unlocked position and cooperable with said shifter to prevent rotation thereof whenever said locking catch is in the locked position, said shifter including a slot, said slot extending in a plane substantially perpendicular to the axis of rotation of said shifter, said locking catch including a member for engagement with said slot whenever said locking catch is positioned in the locked position to thereby prevent rotation of said shifter and actuation of said bolt by the shifter drive means; and said bolt further including an external projection for manual operation of said bolt, said locking catch including a forward projection for cooperation with said bolt whenever said bolt is in the extended position and said catch is in the locked position, whereby manual operation of said bolt against the biasing force thereon disengages said locking catch from said shifter.

* * * * *